US008667884B2

(12) United States Patent
Andersson

(10) Patent No.: US 8,667,884 B2
(45) Date of Patent: Mar. 11, 2014

(54) HYDRAULIC VALVE DEVICE

(75) Inventor: Bo Andersson, Jonkoping (SE)

(73) Assignee: Nordhydraulic AB, Kramfors (SE)

( * ) Notice: Subject to any disclaimer, the term of this patent is extended or adjusted under 35 U.S.C. 154(b) by 1155 days.

(21) Appl. No.: 12/599,600

(22) PCT Filed: May 12, 2008

(86) PCT No.: PCT/SE2008/050548

§ 371 (c)(1),
(2), (4) Date: Nov. 10, 2009

(87) PCT Pub. No.: WO2008/147303

PCT Pub. Date: Dec. 4, 2008

(65) Prior Publication Data

US 2010/0236234 A1 Sep. 23, 2010

(30) Foreign Application Priority Data

May 11, 2007 (SE) ..... 0701142

(51) Int. Cl.
*F15B 11/024* (2006.01)
*F15B 11/044* (2006.01)

(52) U.S. Cl.
USPC ..... 91/421; 91/436

(58) Field of Classification Search
USPC ..... 91/420, 421, 436
See application file for complete search history.

(56) References Cited

U.S. PATENT DOCUMENTS

| | | | | |
|---|---|---|---|---|
| 4,610,193 | A * | 9/1986 | Barker et al. | 91/420 |
| 5,191,826 | A | 3/1993 | Brunner | |
| 5,259,293 | A | 11/1993 | Brunner | |
| 5,479,778 | A * | 1/1996 | Toyooka et al. | 60/468 |
| 6,170,261 | B1 | 1/2001 | Ishizaki et al. | |
| 7,752,842 | B2 | 7/2010 | Hristov et al. | |
| 2006/0075750 | A1 | 4/2006 | Evans | |

FOREIGN PATENT DOCUMENTS

| | | |
|---|---|---|
| DE | 32 16 580 | 2/1983 |
| DE | 19932948 A1 | 2/2000 |
| WO | 2007019712 A1 | 2/2007 |

* cited by examiner

*Primary Examiner* — F. Daniel Lopez
(74) *Attorney, Agent, or Firm* — Young & Thompson

(57) ABSTRACT

A Hydraulic valve device includes a first engine port and a second engine port to a double acting hydraulic motor, and a pump, a hand valve, which is arranged such that it connects the engine ports to the tank and the pump, and which hand valve has two open positions, wherein the pump in the first open position via a line is connected to the first engine port and the tank via a line is connected to the second engine port, and wherein the pump in the second open position via the line is connected to the second engine port and the tank via the line is connected to the first engine port, and a first nonreturn valve, arranged between the pump and the second engine port and opens towards the second engine port. A piston which by way of the load pressure in the first engine port via a line governs the first nonreturn valve, such that it is kept closed as long as the pump pressure does not exceed the load pressure, and a second nonreturn valve arranged such that it, as long as the hand valve is in its first open position, connects the first engine port to the second engine port and opens in direction towards the second engine port.

9 Claims, 3 Drawing Sheets

HYDRAULIC VALVE DEVICE

TECHNICAL FIELD OF THE INVENTION

The invention relates to a hydraulic valve device and is described by way of examples with particular reference to its application on hydraulically driven and manoeuvred lifting booms, which are common in many mobile machines such as e.g. wheel-loaders and digging machines.

BACKGROUND

Many mobile machines include a lifting boom that may be swung up and down by means of a double acting hydraulic lift cylinder that acts between the lifting boom and frame work or base of the machine. This particular lift cylinder is included in a hydraulic system comprising a hydraulic pump and a hand valve, by means of which the pump may be connected to the first lift cylinder chamber when the boom is to be elevated and to the second lift cylinder chamber when the boom is to be sunk. Simultaneously, in the first case the second lift cylinder chamber, and in the second case the first lift cylinder chamber is, via the hand valve, connected to a tank for the hydraulic fluid.

Thus, in the most basic embodiment, the hydraulic valve device is such arranged that the pump fills the first lift cylinder chamber when the boom is to be elevated or sunk, such that the hydraulic fluid that is pressed out from the other lift cylinder chamber is released to the tank. Depending on if the boom is moved with or against the load, the pump will have to work much or less in order to achieve the necessary pressure for the operation. However, it must always deliver a sufficient flow to fill the emptying lift cylinder chamber in a pace that allows movement of the boom in the speed desired by the operator.

An unsatisfactory problem of an arrangement of the described type is that it makes the efficiency of the hydraulic system low at lowering of a load since the pump delivers pressure and flow even though the boom could be sunk by means of its own weight and load.

OBJECT OF THE INVENTION

The object of the present invention is to find a solution to these problems and provide a valve device that saves a substantial part of the energy that is lost at lowering of a load with conventional hydraulic load control valves of the type described above.

This is achieved in accordance with a first aspect of the invention by means of a hydraulic valve device comprising a first engine port and a second engine port to a double acting hydraulic motor, in particular a double acting hydraulic cylinder; a tank and a pump; a hand valve which is arranged such that it connects the engine ports to the tank and the pump, and which hand valve has two open positions, wherein it in the first open position, via a line connects the pump to the first engine port and the tank to the second engine port, and in the second open position via a line connects the pump to the second engine port and the tank to the first engine port; a first nonreturn valve, which is arranged between the pump and the second engine port and opens towards the second engine port. Additionally, a piston, which via a line and by means of the load pressure in the first engine port governs the first nonreturn valve, such that this is kept closed as long as the pump pressure does not exceed said load pressure; and a second nonreturn valve, which is arranged such that it, when the hand valve is in its first open position, connects the first engine port to the second engine port and opens towards the second engine port.

Due to this valve device the hydraulic fluid from the first engine port will, when the pressure at it is sufficiently high, refill the second engine port, such that the pump does not have to work in order to lower a load.

In advantageous embodiments of the invention the valve device is arranged such that refilling may be achieved in both directions, which is advantageous for machines where the load may act in two directions.

The invention is described in detail below, with reference to the accompanying drawings.

SHORT DESCRIPTION OF THE DRAWINGS

DETAILED DESCRIPTION OF THE FIGURES

Figure 1:
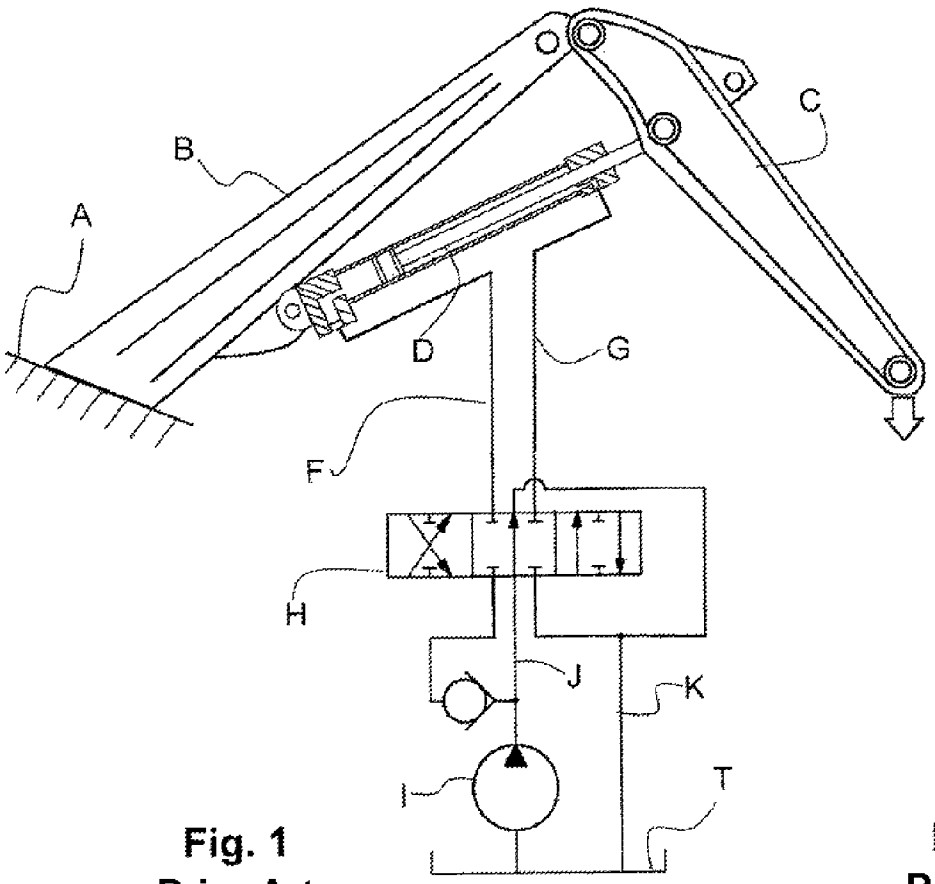
Fig. 1 Prior Art
FIG. 1 shows a vehicle with a hydraulically manoeuvred boom and a hydraulic system with a double acting hydraulic lift cylinder and a conventional valve device mounted thereon.

The hydraulically manoeuvred lifting boom shown in FIG. 1 is adapted to be arranged on a vehicle (not shown) and has a base A with a rotatable crane B, which carries the boom arm C at its upper end. A double acting hydraulic motor, in form of a hydraulic lift cylinder D is arranged between the boom arm C and the foot of the crane B of the base. Lines F and G connect the two lift cylinder chambers to a hand valve H, which in the shown example is lever controlled and in turn is connected to a hydraulic pump and a tank T via additional lines J and K, respectively.

Figure 2:
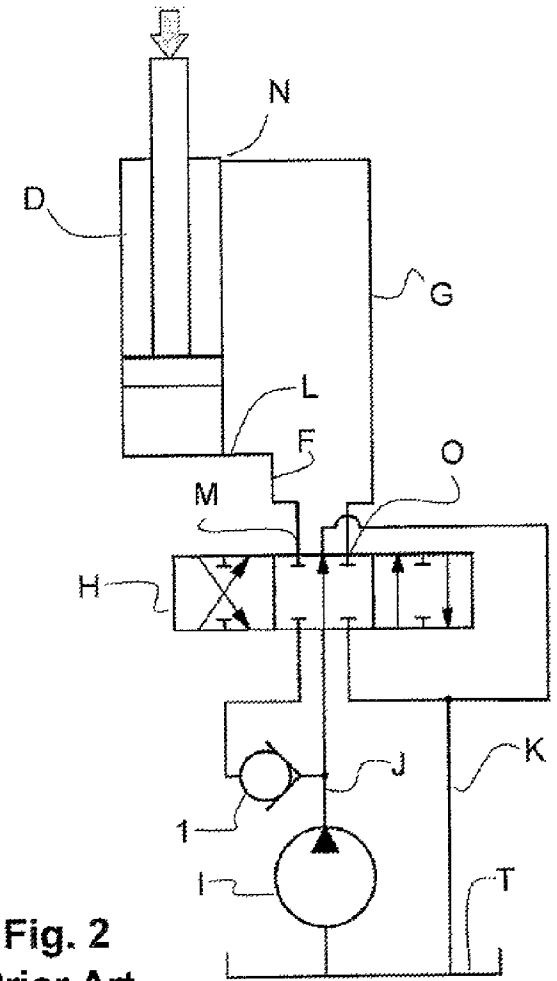
Fig. 2 Prior Art
FIG. 2 is a hydraulic diagram for the lift cylinder in FIG. 1, provided with a conventional valve device.

In FIG. 2, a part of the hydraulic system of the machine, which is useful to manoeuvre the lift cylinder D, is shown. The first, lower, chamber of the lift cylinder (the lifting chamber), has a first engine port, hereafter called the lower lift cylinder port L, as the lift cylinder D constitutes the motor. The line F connects the lift cylinder port to a first feed connection port or operational port M on the hand valve H, which in the shown example is of an open centre type. The second, upper chamber of the lift cylinder (the release chamber) correspondingly has a second engine port, called upper lift cylinder port N, which is connected to a second operational port O on the hand valve H, via the line G. When the hand valve is in the position shown in the figure, the pump flow flows through the centre line of the hand valve to the line K and on to the tank T.

The fluid flows through the valve back to the tank with a very low pump pressure why very little energy is consumed. However, as long as the motor is running it is common procedure to let the pump work and it is thus not expected to turn off the pump I just because there is no instantaneous need to change the position of the boom.

As soon as the hand valve is manoeuvred in any direction, the centre line will be partly closed and the pump I will be connected to one of the chambers of the lift cylinder, whereby the second chamber of the lift cylinder to a correspondingly degree will be connected to the tank T. If the pressure delivered by the pump is sufficiently high, a certain flow will flow through the hand valve to the connected lift cylinder chamber at the same time as the other lift cylinder chamber to a correspondingly degree is emptied to the tank T, whereby the boom will be moved.

When the boom C is raised (raising of a positive load) the hand valve H directs the hydraulic fluid under high pressure from the pump through the first operational port M and the line F to the lower chamber of the lift cylinder D. Since the pump pressure must act against the load in this instance in order to open the nonreturn valve 1, the pump pressure must be controlled to a relatively high level, i.e. sufficiently high so that the pressure in the line J exceeds the pressure in the lower chamber of the lift cylinder D and thus the line F, before the pump flow will fill the lower chamber of the lift cylinder D. Thus, on manoeuvring of the hand valve H, the opening of the centre line is reduced, whereby the pump pressure increases. At the same time the valve opens from the feed connection port M to the lower cylinder port L and from the upper cylinder port N to the tank connection O of the valve. When the valve is manoeuvred such that the pump pressure exceeds the pressure in the cylinder port, the nonreturn valve 1 opens and a flow from the pump to the cylinder is released. Upon further manoeuvring of the valve the flow through the valve to the cylinder increases. Hydraulic fluid will at the same time under low pressure flow through the line G and the hand valve H to the tank T.

The nonreturn valve 1 in the feed line J of the valve H prevents flow "in the wrong direction", opposite the pump flow, upon activation of the valve and when the pump pressure is lower than the pressure in the port of the cylinder, which otherwise would constitute a great danger.

When the boom C is lowered (lowering of a positive load) the hydraulic fluid from the pump is directed through the second operational port O of the hand valve H to the upper chamber in the lift cylinder D, and the hydraulic fluid from the lower lift cylinder chamber is directed to the tank T.

On command the valve between the lower cylinder port L and the tank T opens, resulting in that the cylinder is moved downwards in the figure. Simultaneously the centre line is closed and the pump pressure increases, wherein a flow from the pump to the suction side of the cylinder, i.e. the upper cylinder port N, is provided. The pump flow at a lowering movement involves a loss of energy, which is a disadvantage of this system.

An automatic restriction of the energy loss created in the system in FIG. 2 may be achieved by means of an automatic low pressure regeneration in accordance with the invention. The valve device according to the invention represents a substantial improvement with respect to the efficiency loss compared to the prior art, as represented in FIGS. 1 and 2. Four exemplifying embodiments of the invention are shown in FIGS. 3, 4, 5 and 6.

Figure 3:
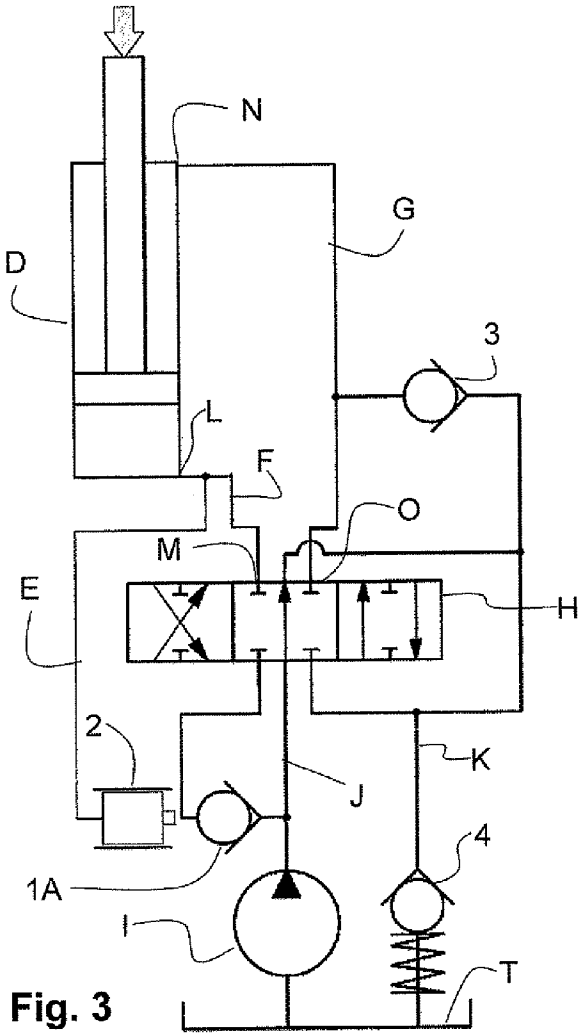
FIG. 3 is a hydraulic diagram resembling the one in FIG. 2, but showing a valve device in accordance with a first embodiment of the invention.

The representation of the diagram of FIG. 3 differs from FIG. 2 in that the nonreturn valve 1A is complemented with a piston 2, which is governed by the load pressure in the lower lift cylinder port L. Further, a nonreturn valve 3 is arranged and connects the centre line and the line K leading to the tank T to the upper lift cylinder port N. The nonreturn valve 3 opens towards the upper lift cylinder port N and closes towards the centre line. Additionally, on the line K, a back-pressure valve or a pre-stressed nonreturn valve 4 may be arranged to open towards the tank T, at a certain pressure. The nonreturn valve 4 is mainly intended to create a certain resistance for the hydraulic fluid towards the tank T, but as there often exits a certain inherent resistance in the lines towards the tank, this nonreturn valve 4 is not always needed.

At lowering of the cylinder piston, the valve is manoeuvred such that a flow from the lower lift cylinder port L, which is subjected to a load, to the tank is obtained, which results in a sinking movement of the cylinder piston. At the same time, the pump flow is prevented from flowing to the suction side of the cylinder, i.e. the upper lift cylinder port N due to that the load pressure at the lower lift cylinder port L via the piston 2 keeps the nonreturn valve 1A in a closed position. Instead, the suction side of the cylinder is refilled via the nonreturn valve 3, which redirects the flow from the pressure side of the cylinder, i.e. the lower lift cylinder port L, to its suction side, via the tank line G. The back-pressure valve 4 in the tank line makes sure that the outlet flow from the pressure side of the cylinder in the first event flows to the suction side of the cylinder. However, since the lower cylinder has a greater volume than the upper cylinder a certain flow flows through the back-pressure valve 4 to the tank T.

The back-pressure valve 4 may be adapted for a low pressure e.g. 3 Bar, which does not provide an efficiency loss of importance upon raising of a load.

If the load, turns into a lifting load while the cylinder piston is being lowered, such that the upper chamber and hence the port N of the lift cylinder becomes put under pressure, the pressure acting on the piston 2 will cease, whereupon the nonreturn valve 1A automatically will open such that the pump may direct the pump flow to the port N of the upper cylinder chamber. Thus, the upper cylinder chamber may be filled regardless of if the load that acts on the cylinder is positive or negative, but when the load is positive the piston 2 will keep the nonreturn valve 1A closed, such that the upper cylinder chamber is filled solely with hydraulic fluid from the port L of the lower lift cylinder chamber, which is under pressure. This method is in this application referred to as automatic low pressure regeneration.

Figure 4:
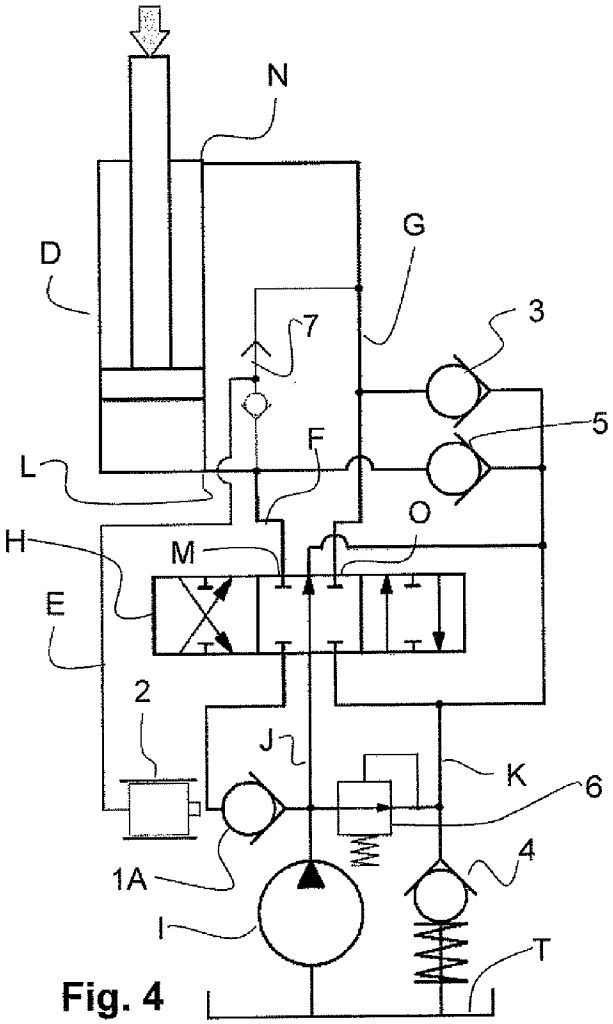
FIG. 4 is a hydraulic diagram showing a valve device in accordance with a second embodiment of the invention.

If the cylinder is arranged such that it may be exerted to both pressing and tensioning pressure load, the automatic low pressure regeneration may be useful in both directions. Such a valve device is shown in FIG. 4. In this second embodiment of the invention, the device is complemented by a nonreturn valve 5 from the tank line K to the lower cylinder port L and by a reverse valve 7 that directs the highest cylinder port pressure to the piston 2 of the nonreturn valve 1A.

When the cylinder piston is raised, the flow out from the upper cylinder port N is, due to the ratio between the different cross sections of the cylinder, less than what is needed to fill up the upper lift cylinder port L. However, a pressure reducing valve 6 adjusted for a lower pressure than the back-pressure valve 4, is arranged to open when the pressure in the tank line K goes below a certain pressure such that the pump flow may flow through the same and guarantee some pressure in the tank line K, such that cavitation on the suction side of the cylinder is avoided. The pressure reducing valve 6 is arranged to open at a lower pressure than the back-pressure valve 4, such that it does not open when there exists a flow to the tank T.

If it is desired to raise a negative load, i.e. to move the piston rod in the direction of a load acting upwards, the hand valve H may be manoeuvred to a first open position, at which the outlets of the pump I and the nonreturn valve 1A are connected to the first operational port M and hence to the lower lift cylinder port L. Simultaneously, the upper lift cylfinder port N will become connected to the tank line K, via the second operational port O, and since the upper cylinder is on load the hydraulic fluid flowing out from the upper lift cylinder port N has a high pressure, such that the pressure reducing valve 6 is initially kept close. Additionally, the same pressure will be transmitted from the reverse valve 7 via the line E to the piston 2 of the nonreturn valve 1A, such that this is kept closed. Due to the low pressure at the negatively loaded lower lift cylinder port L the flow from the upper cylinder port N will flow through the nonreturn valve 5 to said lower lift cylinder port L. Since the centre line of the hand valve is throttled the more it is moved towards the first open position the pressure will decrease in the line K, as a consequence of that the hydraulic fluid from the upper cylinder port N is not enough to fill the lower cylinder, whereby the pressure reducing valve 6 opens, such that the pump flow may flow under a very low pressure to the line K and on through the nonreturn valve 5 to the lower the cylinder L, wherein cavitation in it is avoided in a most energy saving manner.

If, on the contrary and in a corresponding manner, it is desired to sink a positive load, i.e. to move the piston rod in the direction of a load acting downwards the hand valve H may be manoeuvred to a second open position, in which the outlets of the pump I and the nonreturn valves 1A is connected to the second operational port O. and hence to the upper lift cylinder port N. Simultaneously, the lower lift cylinder port L will be connected to the tank line K, via the second operational port M, and since the lower cylinder is on load the hydraulic fluid flows out from it under high pressure, whereby the pressure reducing valve 6 will be kept closed. Additionally, the same pressure will be transmitted from the reverse valve 7 to the piston 2 of the nonreturn valve 1A, via the line E, such that this is kept closed. The pump flow will thus flow through the open centre of the hand valve H to the line K under a low pressure. Due to the low pressure at the negatively loaded lower lift cylinder port L, the flow will in the first instance flow through the nonreturn valve 5 to said lift cylinder port L, wherein the surplus flows via the nonreturn valve 4 to the tank T.

Figure 5:
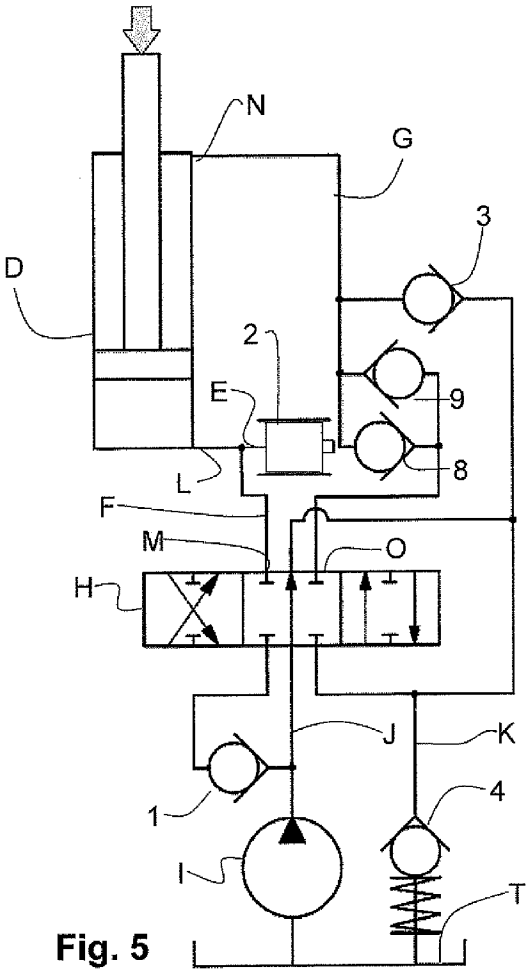
FIG. 5 is a hydraulic diagram showing a valve device in accordance with a third embodiment of the invention.

FIG. 5, shows a valve device resembling the valve device in FIG. 3, but in which the nonreturn valve with a piston is placed closer to the cylinder. The function of the valve device in FIG. 5 is the same as for the valve device in FIG. 3. A reason for arranging two different embodiments having the same functions is that they may present alternative for different existing hydraulic systems and that one may be advantageous in certain systems, while the other is better suited for other types of systems. This choice is mainly dependent on whether it is desired to keep the components, such as valves and similar, gathered close to the lift cylinder or not.

In order to replace the function of the nonreturn valve 1A with a piston shown in FIG. 3, two additional nonreturn valves 8 and 9 are needed to achieve the same function, and a nonreturn valve 1, which corresponds to the nonreturn valve 1A in FIGS. 3 and 4 without piston, is arranged to prevent flow opposite to the pump flow. The nonreturn valve 8, which by means of the piston 2 is governed by the pressure in the lower cylinder port L, takes the part of all the parts of the nonreturn valve 1A in FIG. 3, when the feed connection M is connected to the upper cylinder port N to fill the same. If a load acts downwards on the cylinder, this nonreturn valve 8 will be kept closed, as result of to the load pressure towards the piston 2. Thus, the pump flow will flow under low pressure back to the tank T, while the hydraulic fluid that is allowed to leave the lower cylinder port L towards valve port M and the line K will refill the upper cylinder chamber via the nonreturn valve 3. The anti parallel nonreturn valve 9 is necessary in order to allow the upper cylinder chamber to empty to the tank.

In correspondence with the embodiment shown in FIG. 3 the embodiment shown in FIG. 5 only offers automatic low pressure regeneration in one direction. Therefore, in FIG. 6 an embodiment that resembles the embodiment shown in FIG. 5, but which in correspondence to the embodiment of FIG. 4 offers automatic low pressure regeneration in two directions, is shown.

Figure 6:
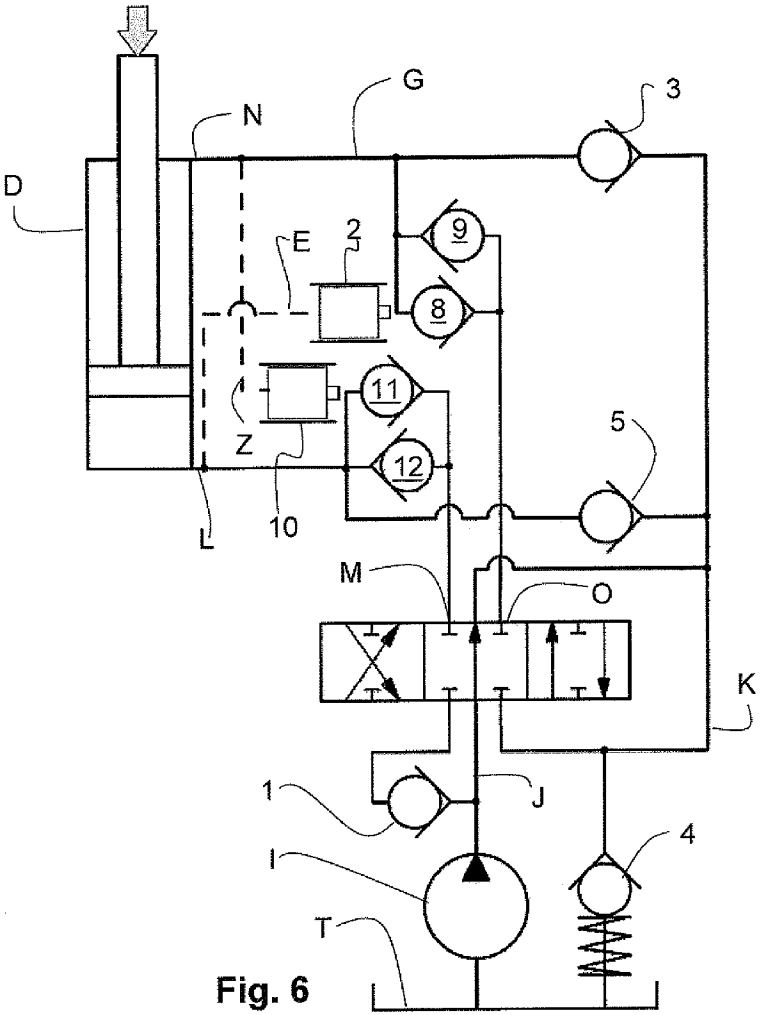
FIG. 6 is a hydraulic diagram showing a valve device in accordance with a fourth embodiment of the invention.

In the diagram of FIG. 6, two pistons 2 and 10, and in connection to these, four nonreturn valves 8, 9 and 11, 12, are arranged, two for each piston. The piston 2 and the nonreturn valves 8 and 9 are arranged exactly in the same manner as in FIG. 5, while the piston 2 and the nonreturn valves 11 and 12 are arranged in a corresponding manner, except that they control the flow to and from the lower cylinder chamber L instead of the upper.

Thus, when a negative load is exerted on the cylinder, i.e. when the piston rod is being loaded from below in the figure, the pressure from the load will, by means of the piston 10, keep the nonreturn valve 11 closed, such that the pump flow instead chooses the path through the centre line of the hand valve H, via the nonreturn valve 4, to the tank T. The lower cylinder chamber will then be filled primarily with return flow from the upper cylinder chamber, which flows via the nonreturn valve 9 through the hand valve H to the tank line K, where it is added to the pump flow. Since the nonreturn valve 4 is lightly pre-stressed the flow will primarily be lead through the nonreturn valve 5 to the lower lift cylinder port L.

As mentioned above, the flow from the upper lift cylinder port N is not enough, due to ratio of the sectional areas, to fill the lower cylinder chamber, but since the flow from the upper cylinder chamber is completed with the pump flow, there is no risk for cavitation in the lower cylinder chamber. Thus, on movement in direction with a negative load, the pump has to deliver a certain flow in order to avoid cavitation, as opposed to when the cylinder piston is moved in direction with a positive load where the return flow from the lower lift cylinder port L is sufficient to alone fill the upper cylinder chamber N.

The invention has been described with reference to four embodiments with the same particular application. However, it is obvious to a person skilled in the art that various embodiments and applications are feasible for the invention, the scope of which is only limited by the following claims.

The invention claimed is:

1. A hydraulic valve device comprising:

a double acting hydraulic motor (D), in particular a double acting hydraulic cylinder, with a first engine port (L) and a second engine port (N);

a tank (T);

a pump (I);

a hand valve (H), connecting the first and second engine ports (L, N) to the tank (T) and the pump (I), said hand valve (H) having first and second open positions, wherein, in the first open position, the pump (I) is connected to the first engine port (L) via a first line (F), and the tank (T) connected to the second engine port (N) via a second line (G), and wherein, in the second open position, the pump (I) is connected to the second engine port (N) via the second line (G), and the tank (T) is connected to the first engine port (L) via the first line (F);

a first nonreturn valve (1A, 8), arranged to operate between the pump (I) and the second engine port (N) and opens towards the second engine port (N);

a piston (2) that, by means of a load pressure in the first engine port (L) via a third line (E), governs the first nonreturn valve (1A, 8), such that the first nonreturn valve (1A, 8) is kept closed as long as a pump pressure does not exceed said load pressure;

a second nonreturn valve configured to, as long as the hand valve (H) is in the second open position, connect the first engine port (L) to the second engine port (N) and opens in a direction towards the second engine port (N); and a back-pressure valve (4) on a fourth line (K) towards the tank (T) to create a resistance in said fourth line (K) towards the tank (T).

2. The valve device according to claim 1, wherein the first nonreturn valve (1A) is located between the pump (I) and the hand valve (H) and opens towards the hand valve (H).

3. The valve device according to claim 2, wherein the hand valve (H) has an open centre, which opens towards the fourth line (K) to the tank (T), wherein the pump flow is led via the fourth line (K) to the tank (T) when the hand valve is in a neutral position.

4. The valve device according to claim 3, wherein the second nonreturn valve connects the fourth line (K) to the second line (G) and opens towards the second line (G), hydraulic fluid from the second engine port (N) in the first open position of the hand valve (H) being led through the hand valve to the fourth line (K).

5. The valve device according to claim 4, further comprising:

a third nonreturn valve that connects the fourth line (K) to the first line (F) and opens towards the first line (F);

a pressure reducing valve (6) that opens from a fifth line (J) towards the fourth line (K) when the pressure in the fourth line (K) is below a pressure that is lower than a pressure required to open the back-pressure valve (4); and a reverse valve (7) that transmits a highest cylinder port pressure to the piston (2) of the first nonreturn valve (1A), such that the first nonreturn valve (1A) is kept closed as long as the pump pressure does not exceed said highest cylinder port pressure.

6. The valve device according to claim 1, wherein a third nonreturn valve (8) is arranged on the second line (G) between the hand valve (H) and the second engine port (N) and opens towards the second engine port (N), and a fourth nonreturn valve (9) anti parallel to the third nonreturn valve (8) is arranged on the second line (G).

7. A hydraulic valve device comprising;

a double acting hydraulic motor (D), in particular a double acting hydraulic cylinder, with a first engine port (L) and a second engine port (N);

a tank (T);

a pump (I);

a hand valve (H) connecting the first and second engine ports (L, N) to the tank (T) and the pump (I), said hand valve (H) having first and second open positions, wherein, in the first open position, the pump (I) is connected to the first engine port (L) via a first line (F), and the tank (T) connected to the second engine port (N) via a second line (G), and wherein, in the second open position, the pump (I) is connected to the second engine port (N) via the second line (G), and the tank (T) is connected to the first engine port (L) via the first line (F);

a first nonreturn valve (1A, 8) arranged to operate between the pump (I) and the second engine port (N) and opens towards the second engine port (N);

a piston (2) that, by means of a load pressure in the first engine port (L) via a third line (E), governs the first nonreturn valve (1A, 8) such that the first nonreturn valve (1A, 8) is kept closed as long as a pump pressure does not exceed said load pressure;

a second nonreturn valve configured to, as long as the hand valve (H) is in the second open position, connect the first engine port (L) to the second engine port (N) and open in a direction towards the second engine port (N);

a third nonreturn valve (8) arranged on the second line (G) between the hand valve (H) and the second engine port (N) and configured to open towards the second engine port (N);

a fourth nonreturn valve (9) anti parallel to the third nonreturn valve (8) arranged on the second line (G);

a fifth nonreturn valve (5) that connects a fourth line (K) to the first line (F) and opens towards the line (F);

a sixth nonreturn valve (11) that is arranged on the first line (F) between the hand valve (H) and the first engine port (L) and opens towards the first engine port (L), wherein a seventh nonreturn valve (12) that is anti parallel to the sixth nonreturn valve (11) is arranged on the first line (F); and a second piston (10) that, via a fifth line (Z) by means of the load pressure in the second engine port (N), controls the sixth nonreturn valve (11), such that the sixth nonreturn valve (11) is kept closed as long as the pump pressure does not exceed said load pressure.

8. The valve device according to claim 7, further comprising:

an eighth nonreturn valve arranged between the pump (I) and the hand valve (H), which opens towards the hand valve (H), to prevent a flow opposite to the pump flow.

9. A hydraulic valve device comprising:

a double acting hydraulic motor (D), in particular a double acting hydraulic cylinder, with a first engine port (L) and a second engine port (N);

a tank (T);

a pump (I);

a hand valve (H) connecting the first and second engine ports (L, N) to the tank (T) and the pump (I), said hand valve (H) having first and second open positions, wherein, in the first open position, the pump (I) is connected to the first engine port (L) via a first line (F), and the tank (T) connected to the second engine port (N) via a second line (G), and wherein, in the second open position, the pump (I) is connected to the second engine port (N) via the second line (G), and the tank (T) is connected to the first engine port (L) via the first line (F);

a first nonreturn valve (1A, 8) arranged to operate between the pump (I) and the second engine port (N) and opens towards the second engine port (N);

a piston (2) that, by means of a load pressure in the first engine port (L) via a third line (E), governs the first nonreturn valve (1A, 8) such that the first nonreturn valve (1A, 8) is kept closed as long as a pump pressure does not exceed said load pressure;

a second nonreturn valve configured to, as long as the hand valve (H) is in the second open position, connect the first engine port (L) to the second engine port (N) and open in a direction towards the second engine port (N);

a third nonreturn valve (8) arranged on the second line (G) between the hand valve (H) and the second engine port (N) and configured to open towards the second engine port (N);

a fourth nonreturn valve (9) anti parallel to the third nonreturn valve (8) arranged on the second line (G); and a fifth nonreturn valve arranged between the pump (I) and the hand valve (H), which opens towards the hand valve (H), to prevent a flow opposite to the pump flow.

* * * * *

UNITED STATES PATENT AND TRADEMARK OFFICE

CERTIFICATE OF CORRECTION

PATENT NO. : 8,667,884 B2
APPLICATION NO. : 12/599600
DATED : March 11, 2014
INVENTOR(S) : Bo Andersson It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1157 days.

Signed and Sealed this
Twenty-ninth Day of September, 2015

Michelle K. Lee

Michelle K. Lee
*Director of the United States Patent and Trademark Office*